US006349847B1

(12) United States Patent
Mangla et al.

(10) Patent No.: US 6,349,847 B1
(45) **Date of Patent: *Feb. 26, 2002**

(54) VENTED CONTAINER WITH HANDLES AND EMBOSSMENT

(75) Inventors: Raj K. Mangla, Pittsford, NY (US); J. Scott Dellinger, Buffalo Grove, IL (US); Mark A. Erickson, Lindenhurst, IL (US); Thomas J. Hayes, McHenry, IL (US); Suzanne R. Maslach, Pittsford, NY (US); Mark E. Spencer, Gurnee, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,590

(22) Filed: Oct. 6, 2000

Related U.S. Application Data

(63) Continuation of application No. 09/312,244, filed on May 14, 1999.

(51) Int. Cl.[7] ..... B65D 25/28

(52) U.S. Cl. ..... 220/754; 220/755

(58) Field of Search ..... 206/541, 542, 206/549; 220/574, 575, 752–776; 426/124, 129

(56) References Cited

U.S. PATENT DOCUMENTS

| | | | |
|---|---|---|---|
| D45,254 | S | 2/1914 | Dalton |
| D50,459 | S | 3/1917 | Andrews |
| D66,776 | S | 3/1925 | McDonald |

(List continued on next page.)

FOREIGN PATENT DOCUMENTS

| | | |
|---|---|---|
| BE | 645683 | 3/1964 |
| CA | 790950 | 7/1968 |
| CA | 1109419 | 9/1981 |

(List continued on next page.)

*Primary Examiner*—Jim Foster
(74) *Attorney, Agent, or Firm*—Jenkens & Gilchrist

(57) ABSTRACT

A thermoplastic container for food or other articles is set forth. The container includes a base having a bottom, a pair of opposing side walls and a pair of opposing end walls extending upwardly from the bottom. A pair of integral handle segments are formed with the outer rim of the base and rotatably attached to anchoring portions at integral hinges. The handle segments can be releasably engaged with each other and include a pair of hinged portions. Each hinged portion has at least one upwardly extending rib segment and at least one downwardly extending rib segment interconnected by integral hinges that form definite bending points for the hinged portions of the handle segments so that when the handle segments are upturned, the hinged portion assists in distributing stress and obtaining a proper balance of the container. A plurality of wells designed to retain fluid therein via capillary action or surface tension forces are formed in the bottom such that fluid does not flow out of the wells when the base is tilted or turned upside-down. A cover may be removably attached to the base to define a food storage chamber. A downwardly extending rib formed in the cover rim is intermittently provided with a plurality of cover venting notches which are aligned with respective base venting notches formed in an upwardly extending elongated rib of the base. With the cover in place atop the base, the conjunction of the base venting notches and the cover venting notches define vent openings. Another set of apertures for additional ventilation are provided in the side walls of the cover. Also, multiple containers can be stacked atop each other and the bottom includes at least one elongated recess for substantially receiving a portion of the handle segments to facilitate stacking.

15 Claims, 10 Drawing Sheets

U.S. PATENT DOCUMENTS

| | | | | |
|---|---|---|---|---|
| D67,011 | S | | 4/1925 | Clarke |
| D69,071 | S | | 12/1925 | Goodwin |
| D71,991 | S | | 2/1927 | Walker |
| D72,702 | S | | 5/1927 | Farber |
| D82,327 | S | | 10/1930 | Kempter |
| D82,736 | S | | 12/1930 | Farber |
| 1,848,120 | A | | 3/1932 | Fisher |
| 1,926,240 | A | | 9/1933 | Maas |
| D92,457 | S | | 6/1934 | Forman |
| D93,461 | S | | 10/1934 | Vaulchier |
| D96,461 | S | | 8/1935 | Franklin |
| 2,051,940 | A | | 8/1936 | Chichester-Miles |
| D102,862 | S | | 1/1937 | Sebring |
| D103,307 | S | | 2/1937 | Cory |
| 2,096,825 | A | | 10/1937 | Roman |
| D114,173 | S | | 4/1939 | Cruveilher |
| D116,150 | S | | 8/1939 | Sharlitt et al. |
| D119,403 | S | | 3/1940 | Spence |
| D122,589 | S | | 9/1940 | Bastress |
| 2,246,695 | A | | 6/1941 | Phillips |
| D132,281 | S | | 5/1942 | Miller et al. |
| 2,343,128 | A | | 2/1944 | Anderson |
| 2,352,684 | A | | 7/1944 | Braddock |
| 2,496,619 | A | | 2/1950 | Cunningham, Jr. |
| D163,032 | S | | 4/1951 | Forman |
| D163,110 | S | | 5/1951 | Forman |
| 2,560,910 | A | | 7/1951 | Schnaeel |
| D165,933 | S | | 2/1952 | Peters |
| D166,564 | S | | 4/1952 | Peters |
| 2,637,617 | A | | 5/1953 | Stotter |
| 2,669,379 | A | | 2/1954 | Olson |
| 2,738,915 | A | | 3/1956 | Clair |
| 2,780,385 | A | | 2/1957 | Tupper |
| 2,866,575 | A | * | 12/1958 | Lattuca ..... 220/771 |
| 2,914,104 | A | | 11/1959 | Jocelyn |
| 2,979,844 | A | * | 4/1961 | Lattuca ..... 220/771 |
| D190,751 | S | | 6/1961 | Schwartz et al. |
| 2,999,611 | A | | 9/1961 | Paulson |
| 3,051,346 | A | | 8/1962 | Grogel |
| 3,054,679 | A | | 9/1962 | Bradford |
| D194,155 | S | | 11/1962 | Gottsegen |
| 3,066,824 | A | | 12/1962 | Bostrom |
| D194,682 | S | | 2/1963 | Pachmayr et al. |
| 3,077,284 | A | | 2/1963 | McLaughlin |
| 3,082,900 | A | | 3/1963 | Goodman |
| D195,602 | S | | 7/1963 | Bostrom |
| D195,699 | S | | 7/1963 | Bostrom |
| 3,101,864 | A | | 8/1963 | Glickman |
| 3,104,776 | A | | 9/1963 | Bostrom |
| D197,310 | S | | 1/1964 | Butzko |
| 3,119,541 | A | | 1/1964 | Lynn |
| D197,584 | S | | 2/1964 | Nascher |
| 3,121,507 | A | | 2/1964 | Weiss |
| D197,993 | S | | 4/1964 | Mojonnier |
| 3,131,846 | A | | 5/1964 | Whiteford |
| D198,545 | S | | 6/1964 | Bostrom |
| D198,804 | S | | 8/1964 | Stevens |
| 3,149,747 | A | | 9/1964 | Burgess |
| 3,151,799 | A | | 10/1964 | Engles, Jr. et al. |
| 3,154,215 | A | | 10/1964 | Vesconte |
| 3,172,768 | A | | 3/1965 | Joosten et al. |
| 3,179,036 | A | | 4/1965 | Luker |
| 3,216,148 | A | | 11/1965 | Amberg |
| 3,234,077 | A | | 2/1966 | Reifers et al. |
| 3,246,786 | A | | 4/1966 | Holley |
| 3,252,683 | A | | 5/1966 | Uetzmann |
| 3,253,762 | A | | 5/1966 | Gaunt |
| 3,303,964 | A | | 2/1967 | Luker |
| 3,307,752 | A | | 3/1967 | Anderson |
| 3,310,088 | A | | 3/1967 | Hildebrandt et al. |
| 3,311,252 | A | | 3/1967 | Swartwood et al. |
| 3,318,283 | A | | 5/1967 | Maclam et al. |
| 3,326,408 | A | | 6/1967 | Ringlen |
| 3,335,846 | A | | 8/1967 | Mills |
| 3,344,974 | A | | 10/1967 | Bostrom |
| D209,990 | S | | 1/1968 | Costa, Jr. et al. |
| 3,381,872 | A | | 5/1968 | Holder et al. |
| 3,401,863 | A | | 9/1968 | Earl |
| 3,420,431 | A | | 1/1969 | Donovan |
| 3,430,803 | A | | 3/1969 | Nelson |
| 3,434,625 | A | | 3/1969 | Embry, Jr. |
| D213,718 | S | | 4/1969 | Blisa |
| 3,443,720 | A | | 5/1969 | Al-Roy |
| 3,447,714 | A | | 6/1969 | Elliot |
| 3,452,895 | A | | 7/1969 | Elliot |
| 3,460,711 | A | | 8/1969 | Al-Roy |
| D215,413 | S | | 9/1969 | Donovan |
| 3,464,832 | A | | 9/1969 | Mullinix |
| 3,511,288 | A | | 5/1970 | Swett et al. |
| D218,804 | S | | 9/1970 | Doubleday |
| D218,927 | S | | 10/1970 | Artz |
| 3,552,595 | A | | 1/1971 | Gerner et al. |
| 3,565,146 | A | | 2/1971 | Arnolds |
| D220,031 | S | | 3/1971 | Donovan |
| 3,568,916 | A | | 3/1971 | Scheuring |
| D220,448 | S | | 4/1971 | Swett et al. |
| D220,749 | S | | 5/1971 | Artz |
| D220,752 | S | | 5/1971 | Artz |
| 3,586,162 | A | | 6/1971 | Townsend |
| 3,590,988 | A | | 7/1971 | Hollar |
| D221,604 | S | | 8/1971 | Rodolakis |
| 3,613,938 | A | | 10/1971 | Westcott |
| 3,620,410 | A | | 11/1971 | Griese, Jr. |
| 3,620,411 | A | | 11/1971 | Rump |
| 3,623,633 | A | | 11/1971 | Kinn |
| 3,633,785 | A | | 1/1972 | Cyr et al. |
| D223,144 | S | | 3/1972 | Bloch |
| 3,651,981 | A | | 3/1972 | Kinney |
| D224,206 | S | | 7/1972 | Cyr et al. |
| 3,675,811 | A | | 7/1972 | Artz |
| 3,690,902 | A | | 9/1972 | Dahl |
| D225,050 | S | | 11/1972 | Cannell |
| D225,364 | S | | 12/1972 | Antoni |
| 3,708,086 | A | | 1/1973 | Colato |
| 3,710,975 | A | | 1/1973 | Jansen |
| D226,776 | S | | 4/1973 | Mider |
| T909,015 | I4 | | 4/1973 | Pecka |
| 3,730,382 | A | | 5/1973 | Heisler |
| 3,732,976 | A | | 5/1973 | Bessett et al. |
| D227,226 | S | | 6/1973 | Bird |
| 3,737,068 | A | | 6/1973 | Bird |
| 3,737,069 | A | | 6/1973 | Owen |
| D227,851 | S | | 7/1973 | Nowland et al. |
| 3,753,512 | A | | 8/1973 | Curry |
| 3,770,115 | A | | 11/1973 | Cannell |
| 3,771,712 | A | | 11/1973 | Richards |
| 3,786,982 | A | | 1/1974 | Rakes et al. |
| 3,794,090 | A | | 2/1974 | Commisso |
| 3,795,360 | A | | 3/1974 | Bianchi et al. |
| 3,811,560 | A | | 5/1974 | Schilling et al. |
| 3,815,736 | A | | 6/1974 | Sedlak |
| RE28,059 | E | | 7/1974 | Mounts et al. |
| 3,848,795 | A | | 11/1974 | Bird et al. |
| 3,851,782 | A | | 12/1974 | Clawson et al. |
| 3,851,789 | A | | 12/1974 | Case et al. |
| 3,858,756 | A | | 1/1975 | Fulton |
| 3,858,786 | A | | 1/1975 | Vogt |
| 3,876,130 | A | | 4/1975 | Haase |
| 3,884,383 | A | | 5/1975 | Burch et al. |

D235,498 S 6/1975 Day
D235,499 S 6/1975 Day
3,889,732 A 6/1975 Wilkins
3,900,550 A 8/1975 Oliver et al.
3,902,540 A 9/1975 Commisso
3,912,118 A 10/1975 Bird
3,918,378 A 11/1975 Clawson et al.
3,933,295 A 1/1976 Congleton
3,933,296 A 1/1976 Ruskin et al.
3,935,962 A 2/1976 Schubert et al.
3,964,635 A 6/1976 Ludder
3,997,677 A 12/1976 Hirsch et al.
D243,430 S 2/1977 Thrush
4,030,850 A 6/1977 Hyde
RE29,415 E 9/1977 Ricobene et al.
D246,289 S 11/1977 Boucher
4,057,169 A 11/1977 Payne
4,058,214 A 11/1977 Mancuso
4,061,241 A 12/1977 Retelny
4,078,696 A 3/1978 Crisci
4,079,857 A 3/1978 Crisci
4,081,646 A 3/1978 Goltsos
4,096,986 A 6/1978 Florian
4,098,453 A 7/1978 Arneson
D249,234 S 9/1978 Limon et al.
4,111,305 A 9/1978 Thomas
4,127,189 A 11/1978 Shumrak et al.
D250,929 S 1/1979 Gerstman et al.
4,132,344 A 1/1979 Jewell
4,146,170 A 3/1979 Medendorp
4,159,062 A 6/1979 Levenhagen
D253,514 S 11/1979 Etelson
4,183,435 A 1/1980 Thompson et al.
4,193,496 A 3/1980 Barratt
4,197,940 A 4/1980 DeRossett
4,201,301 A 5/1980 Aggio
4,206,845 A 6/1980 Christian
D255,659 S 7/1980 Dugan et al.
D255,857 S 7/1980 Zimmermann
4,210,248 A 7/1980 Engdahl, Jr.
4,210,674 A 7/1980 Mitchell
4,212,234 A 7/1980 DeCourcy
D256,308 S 8/1980 Zimmermann
D256,646 S 9/1980 Painter et al.
4,234,097 A 11/1980 Daenen
4,244,470 A 1/1981 Burnham
D258,632 S 3/1981 Commisso
4,253,600 A 3/1981 Schubert
D259,543 S 6/1981 Commisso et al.
D259,774 S 7/1981 Criscitiello, Jr.
4,279,357 A 7/1981 Robinson
4,280,635 A 7/1981 Murphy
4,294,371 A 10/1981 Davis
D261,588 S 11/1981 Fischte
4,298,133 A 11/1981 Davis
D263,023 S 2/1982 Commisso
D263,421 S 3/1982 Gilson
D263,798 S 4/1982 Edwards
4,351,164 A 9/1982 Christiani
4,357,042 A 11/1982 Gall
4,360,118 A 11/1982 Stern
4,361,233 A 11/1982 Holkestad
4,362,252 A 12/1982 Graff
4,373,636 A 2/1983 Hoffman
4,375,862 A 3/1983 Kurinsky et al.
4,376,493 A 3/1983 Gall
4,380,304 A 4/1983 Anderson
D269,323 S 6/1983 Cillario
4,390,113 A 6/1983 Bird
4,403,712 A 9/1983 Wiesinger
4,412,630 A 11/1983 Daenen
4,416,906 A 11/1983 Watkins
4,421,244 A 12/1983 Van Melle
4,439,656 A 3/1984 Peleg
4,440,303 A 4/1984 Seager
4,446,986 A 5/1984 Bowen et al.
4,452,356 A 6/1984 Dahl
4,456,164 A 6/1984 Foster et al.
D274,790 S 7/1984 Bixler et al.
4,466,552 A 8/1984 Butterworth et al.
D275,636 S 9/1984 Picozza
4,472,440 A 9/1984 Bank
4,473,165 A 9/1984 Lentjes
4,478,349 A 10/1984 Haverland, Jr. et al.
D276,216 S 11/1984 Michaud
4,486,640 A 12/1984 Bowen et al.
4,494,650 A 1/1985 Cullen
4,503,991 A 3/1985 Joyce
4,505,404 A 3/1985 Perchak et al.
4,505,962 A 3/1985 Lu
4,512,474 A 4/1985 Harding
4,530,344 A 7/1985 Iyengar et al.
D280,060 S 8/1985 Holzkopf
D280,182 S 8/1985 Tyler
4,533,585 A 8/1985 Holden
4,535,889 A 8/1985 Terauds
D281,042 S 10/1985 Antoni et al.
4,545,487 A 10/1985 Asmus
4,548,824 A 10/1985 Mitchell et al.
4,555,024 A 11/1985 Voss et al.
4,555,043 A 11/1985 Bernhardt
4,560,082 A 12/1985 Sutch
4,560,850 A 12/1985 Levendusky et al.
D282,245 S 1/1986 Yeung
4,576,330 A 3/1986 Schepp
D283,666 S 5/1986 Holzkopf
D284,747 S 7/1986 Doman
4,602,719 A 7/1986 Borst
D284,944 S 8/1986 Carlson
D285,638 S 9/1986 Trivison
D287,104 S 12/1986 Holden
D287,207 S 12/1986 Daenen et al.
D287,208 S 12/1986 Daenen et al.
D288,295 S 2/1987 Holden
4,640,838 A 2/1987 Isakson et al.
4,644,931 A 2/1987 Veth
4,648,511 A 3/1987 Ritman
4,650,076 A 3/1987 Padovani
4,653,685 A 3/1987 Leary et al.
4,660,716 A 4/1987 McMahon et al.
4,661,672 A 4/1987 Nakanaga
D290,232 S 6/1987 Holzkopf et al.
D291,066 S 7/1987 Antoine
4,703,149 A 10/1987 Sugisawa et al.
4,704,510 A 11/1987 Matsui
4,705,163 A 11/1987 James
4,730,731 A 3/1988 Allison
4,741,452 A 5/1988 Holzkopf
4,742,934 A 5/1988 Michaud et al.
D296,191 S 6/1988 Yoshida et al.
4,750,614 A 6/1988 Fischer et al.
4,753,351 A 6/1988 Guillin
4,756,446 A 7/1988 Gen et al.
RE32,739 E 8/1988 Terauds
4,764,391 A 8/1988 Wasserman et al.
4,771,934 A 9/1988 Kalmanides
D298,000 S 10/1988 Ritman
D298,304 S 11/1988 Meyer
4,784,273 A 11/1988 Niemetz
D298,791 S 12/1988 Holzkopf
4,801,017 A 1/1989 Artusi
4,802,258 A 2/1989 Jensen 4,809,868 A 3/1989 Pomroy
4,844,263 A 7/1989 Hadtke
4,847,459 A 7/1989 Desai
4,856,674 A 8/1989 Berney
4,859,822 A 8/1989 Ragusa et al.
D303,337 S 9/1989 Holma
4,863,054 A 9/1989 Capetta
4,863,058 A 9/1989 Antoni et al.
4,867,303 A 9/1989 Beckerman et al.
4,873,101 A 10/1989 Larson et al.
4,874,083 A 10/1989 Antoni et al.
4,874,088 A 10/1989 Leben
4,882,463 A 11/1989 Kyougoku et al.
4,883,195 A 11/1989 Ott et al.
D304,909 S 12/1989 Natori
4,889,239 A 12/1989 Sandish et al.
D305,409 S 1/1990 Michaud et al.
4,901,884 A 2/1990 Kallenbach
4,916,280 A 4/1990 Havette
4,919,955 A 4/1990 Mitchell
D309,554 S 7/1990 Meisner
4,941,586 A 7/1990 Tarna
4,947,993 A 8/1990 Bruml et al.
4,962,854 A 10/1990 Ricci
D312,024 S 11/1990 Antoni et al.
D312,025 S 11/1990 Antoni et al.
D312,026 S 11/1990 Antoni et al.
4,974,738 A 12/1990 Kidd et al.
4,976,370 A 12/1990 Cassel
4,991,732 A 2/1991 La Barge et al.
4,994,638 A 2/1991 Iorns et al.
5,004,121 A 4/1991 Howe
5,012,928 A 5/1991 Proffitt et al.
5,018,624 A 5/1991 Arneson et al.
5,027,973 A 7/1991 Drogos
5,046,659 A 9/1991 Warburton
5,094,355 A 3/1992 Clark et al.
5,115,931 A 5/1992 Dubach
D326,743 S 6/1992 Haynes
5,131,551 A 7/1992 Wells
D328,705 S 8/1992 Krupa
D329,198 S 9/1992 Krupa
5,145,068 A 9/1992 Schmitz et al.
5,158,209 A 10/1992 Reil et al.
5,161,710 A 11/1992 Chumley
5,165,947 A 11/1992 Colucci et al.
5,176,259 A 1/1993 Andersen
D334,323 S 3/1993 Rohrbeck
D336,216 S 6/1993 Rohrbeck
5,215,210 A 6/1993 Ostrum et al.
5,224,623 A 7/1993 LaFleur
5,232,112 A 8/1993 Howard
5,236,119 A 8/1993 Chu
D339,744 S 9/1993 Seppala
5,242,696 A 9/1993 McDevitt
D340,882 S 11/1993 Holtkamp, Jr.
D341,316 S 11/1993 Fritz et al.
5,266,763 A 11/1993 Colombo
5,269,430 A 12/1993 Schlauptiz et al.
D343,576 S 1/1994 Krupa
5,287,959 A 2/1994 Hansen et al.
D345,305 S 3/1994 Host
D345,894 S 4/1994 Krupa
D345,912 S 4/1994 Krupa
5,300,748 A 4/1994 Colombo
D346,554 S 5/1994 Krupa
5,322,182 A 6/1994 Fritz
D348,608 S 7/1994 Wyslotsky
D349,456 S 8/1994 Wilson
D349,832 S 8/1994 Sarnoff et al.
5,335,787 A 8/1994 Finchum et al.
5,339,973 A 8/1994 Edwards et al.
5,345,069 A 9/1994 Grindrod
D351,999 S 11/1994 Krupa
D352,000 S 11/1994 Hansen et al.
D352,203 S 11/1994 Campbell et al.
D352,204 S 11/1994 Hayes et al.
5,405,009 A 4/1995 Hackenbracht
D358,091 S 5/1995 Warburton
5,413,239 A 5/1995 Rider, Jr.
5,414,248 A 5/1995 Phillips
5,423,453 A 6/1995 Fritz
5,423,477 A 6/1995 Valdman et al.
D361,036 S 8/1995 Krupa
5,437,383 A 8/1995 Stull
5,441,166 A 8/1995 Lucas, Jr. et al.
D361,935 S 9/1995 Krupa
5,447,234 A 9/1995 Faulstick et al.
5,456,379 A 10/1995 Krupa et al.
D363,879 S 11/1995 Krupa et al.
5,464,969 A 11/1995 Miller
5,469,986 A * 11/1995 Jang ..... 220/762
5,471,718 A 12/1995 Harrill
D366,395 S 1/1996 Wyatt et al.
D366,613 S 1/1996 Fultz
5,515,993 A 5/1996 McManus
5,518,133 A 5/1996 Hayes et al.
5,520,306 A 5/1996 Umiker
5,529,178 A 6/1996 Gorlich
D374,376 S 10/1996 Goins et al.
D375,683 S 11/1996 Schoff
5,577,627 A 11/1996 Richie-Dubler
5,587,192 A 12/1996 Beizermann
D377,580 S 1/1997 Hayes et al.
D378,180 S 2/1997 Hayes et al.
5,605,231 A 2/1997 Borsboom et al.
5,605,646 A 2/1997 Colombo et al.
5,607,709 A 3/1997 Fritz et al.
D379,431 S 5/1997 Mangla
D379,587 S 6/1997 Goins et al.
D382,795 S 8/1997 Abayhan et al.
D382,796 S 8/1997 Mangla
D384,247 S 9/1997 Smith et al.
5,662,237 A 9/1997 Cain
D384,862 S 10/1997 Hayes et al.
D386,075 S 11/1997 Hayes et al.
D386,081 S 11/1997 Hayes et al.
5,685,453 A 11/1997 Goins et al.
5,693,388 A 12/1997 Castner et al.
D388,699 S 1/1998 Hayes et al.
D388,703 S 1/1998 Hayes et al.
D389,056 S 1/1998 Hayes et al.
D389,057 S 1/1998 Hayes et al.
5,705,213 A 1/1998 Guillin
5,709,897 A 1/1998 Pearlstein
5,715,968 A * 2/1998 Fink et al. ..... 220/669
5,720,999 A 2/1998 Lanzani et al.
D392,881 S 3/1998 Bulcher et al.
5,730,313 A 3/1998 Hayes et al.
D393,204 S 4/1998 Goins et al.
D393,801 S 4/1998 Hayes et al.
D394,985 S 6/1998 Curtis et al.
5,758,791 A 6/1998 Mangla
5,758,794 A 6/1998 Rider, Jr. et al.
5,762,231 A 6/1998 Rider, Jr. et al.
5,772,070 A 6/1998 Hayes et al.

FOREIGN PATENT DOCUMENTS

CA 1117491 2/1982
CA 1187045 5/1985
CH 476613 9/1969
DE 31 10847 9/1982

| | | |
|---|---|---|
| DE | 39 43 301 | 7/1991 |
| EP | 0 563 781 | 10/1993 |
| FR | 1473278 | 2/1967 |
| GB | 2 044 226 | 10/1980 |
| GB | 2 078 095 | 1/1982 |
| IT | 436471 | 8/1948 |
| JP | 60 84519 | 5/1985 |
| JP | 4 6035 | 1/1992 |

* cited by examiner

VENTED CONTAINER WITH HANDLES AND EMBOSSMENT

This application is a continuation of U.S. patent application Ser. No. 09/312,244, filed May 14, 1999.

FIELD OF THE INVENTION

This invention relates generally to thermoformed containers for foods or other articles, and in particular, to a container having a ventilation system, integrally formed handles, and an embossed bottom surface for retaining liquid with surface tension forces.

BACKGROUND OF THE INVENTION

In many grocery stores and restaurants, particularly quick service restaurants, deli counters, or rotisserie/fried chicken stations, various food products are typically not served to the customer open on a plate immediately after being cooked. Rather, the food products are placed into individual containers so that each container can be handled, stored, reheated, or packaged in a bag, easily and conveniently. After cooking but before being served, the food products may be packaged and held in a holding area either at the store, during transport, or at home for a short period of time. This is especially true when a quick service restaurant or deli prepares and pre-packs a number of food products in anticipation of the traditional busy periods of lunch and dinner.

During this holding period before being served, certain food products can undergo changes in temperature, appearance, texture, and flavor. For example, the edges of hamburgers may get relatively cold and hard, or french fries may soak up vegetable oil which remains on their surfaces after cooking, pizza may become soggy, roasted chicken may dry-out, and fried chicken may lose its crunchiness. These changes in appearance and flavor tend to decrease customer satisfaction with these food products. Also, the efficiency with which food products can be served during busy hours is decreased as foods are not capable of being pre-packaged for fear of these unappealing changes. The decreased temperature and quality of appearance, texture, and flavor make these food products less appetizing.

It is also known that certain food products, such as fried chicken, emit moisture or water vapor along with latent heat stored in the chicken due to cooking and heating. At least a portion of this latent heat and moisture can condense on and be reabsorbed by the chicken itself, making the fried chicken soggy, less crispy, and tough to chew. Also, the water vapor can condense on the interior surfaces of the container and drip down towards the bottom of the container for the bottom pieces of fried chicken to absorb. If air circulation adjacent to and around the chicken is poor, the water reabsorption by the chicken increases since the latent heat and the resultant water vapor is further prevented from circulating away from the chicken. Further, if air from inside the container is not allowed to be exchanged with the air from outside the container, condensation of the water vapor on the inside of the container is more likely. Although a relatively small amount of water vapor escapes from the chicken and condenses, or is prevented from circulating away from the chicken, this amount may be enough to make the chicken undesirable.

After the water vapor condenses on the surface of the container and migrates to the bottom of the container, it mixes with the residual grease and juices that have exuded from the food product. After cooling and sitting for a period of time in such fluid, a piece of fried chicken, for example, may lose its delicious batter as it is lifted from the container with the delicious batter or breading remaining glued to the bottom surface. Also, after sitting in its own soup of grease, moisture, and meat juice, a piece of food product may become half-soaked with such fluid. Hence, there is also a need for containers that are more efficient in preventing excess grease and moisture from contacting the food.

Numerous attempts have been made to provide a container which prevents condensation from the food product from being reabsorbed. U.S. Pat. No. 5,423,477 to Valdman et al. issued Jun. 13, 1995, discloses a pizza box which incorporates a cover coated with a moisture absorbing inner layer of starch.

Also, a wide variety of container inserts have been developed to improve the quality of food especially when cooked in a microwave oven. For instance, it is known to place a fluid absorbent pad within a package for absorbing food by-products such as moisture and grease exuded from food during cooking in a microwave oven as shown in U.S. Pat. No. 4,873,101 issued to Larson et al. on Oct. 10, 1989. Such pads must not only provide a sufficient capacity for the quantity of food by-products produced during cooking, but also, must withstand the elevated temperatures required to adequately heat the precooked foods without degradation.

Other patents describe ways to exchange air between the interior of the container and the outside air to allow water vapor to escape. For example, U.S. Pat. No. 3,335,846, issued to R. E. Mills on Aug. 15, 1967, describes a container for pizza having a series of venting channels permitting such an exchange. The cover in this container is provided with one or more openings so that vapors from the interior of the container may be vented to the atmosphere.

One difficulty with prior art containers designed to keep moisture away from heated food is that the specialized coatings and layered construction make the containers both prohibitively expensive and difficult to manufacture. Although these techniques may have been helpful in preventing certain food products from becoming soggy, an improved container is desired.

Other problems with prior art containers, such as the visibility of grease and moisture, the spillage of fluid through venting apertures, and the inefficiencies associated with pre-packing, are discussed below.

There is a need for hiding the resulting fluid by-product, especially the fattening grease, from the consumer. Traditionally, bucket-type containers or fold-out boxes made from paperboard or other easily formed low-cost and grease absorbing material have been used in the market. When using paper buckets or fold-out paper boxes, the problem is compounded when the food product is allowed to sit inside the container. After a period of time, grease begins to soak through and stain the container revealing the food's high-fat content. Such a container, much less its contents, quickly becomes unappealing to the fat-conscious consumer.

Another problem is the danger of spillage. During the holding period and, in particular, during transport, food juices may spill from the container and stain clothing and upholstery. Hence, preventing run-off of the food juices is of primary importance, especially if the container has vent openings large enough to permit food and juice to pass.

Furthermore, pre-packing frequently ordered food product can minimize wage labor time, especially during busy dining hours. However, using opaque paperboard containers leads wary consumers to re-open and check prepackaged containers for the right order. This inconvenience has increased demand for food packages that will attractively display and allow the consumer to view a substantial portion of the food product while at the same time providing for convenience in handling.

SUMMARY OF THE INVENTION

The present invention is a thermoplastic container. In accordance with one embodiment, the container includes a base having a bottom, a pair of opposing side walls and a pair of opposing end walls. The side walls and end walls extend upwardly from the bottom, and the end walls extend between the side walls. A rim encompasses an upper edge of the side walls and end walls and extends laterally outwardly therefrom. The bottom also includes a plurality of depending wells sufficiently small to retain a volume of fluid in the wells via capillary action or surface tension forces such that the volume of fluid therein does not flow out when the base is tilted or turned upside-down. Each of the wells has an interior surface area. The ratio of the volume of fluid to the interior surface area is in the range of approximately $2.8\times10^{-2}$ in to $3.8\times10^{-3}$ in.

In accordance with another embodiment, the container includes a base having a bottom, a pair of opposing side walls and a pair of opposing end walls. The side walls and end walls extend upward from the bottom, and the end walls extend between the side walls. A base rim encompasses an upper edge of the side walls and end walls and extends laterally outwardly therefrom. The rim has an integrally formed outer flange and a pair of opposing anchoring portions. The outer flange includes a pair of opposing handle segments, each having a pair of generally parallel hinged portions and a beaded graspable portion extending between the hinged portions. The hinged portions are rotatably connected to respective anchoring portions for upward and downward swinging movements. The handle segments include means for releasably engaging the handle segments to each other. Each of the hinged portions have at least one upwardly extending rib segment extending upwardly from an upper surface of the associated hinged portion, at least one downwardly extending rib segment extending downwardly from a lower surface of the associated hinged portion, and at least one integral hinge forming a definite bending point.

In accordance with yet another embodiment, the container includes a base having a bottom, a pair of opposing base side walls, a pair of opposing base end walls, and a base rim. The base side walls and base end walls extend upward from the bottom, and the base end walls extend between the base side walls. A base rim encompasses an upper edge of the base side walls and base end walls and extends laterally outwardly therefrom. The base rim has an upwardly protruding elongated rib with base venting notches intermittently interrupting the upwardly protruding rib. The container further includes a cover having a top, a pair of opposing cover side walls, a pair of opposing cover end walls, and a cover rim. The cover side walls and the cover end walls extend downward from the top, and the cover end walls extend between the cover side walls. The cover rim encompasses a lower edge of the cover side walls and the cover end walls and extends laterally outwardly therefrom. The cover rim has a downwardly protruding rib with cover venting notches intermittently interrupting the downwardly protruding rib. The cover venting notches are aligned with respective base venting notches and form respective vent openings when the cover is secured atop the base.

BRIEF DESCRIPTION OF THE DRAWINGS

Other objects and advantages of the invention will become apparent upon reading the following detailed description and upon reference to the drawings in which.

Figure 1:
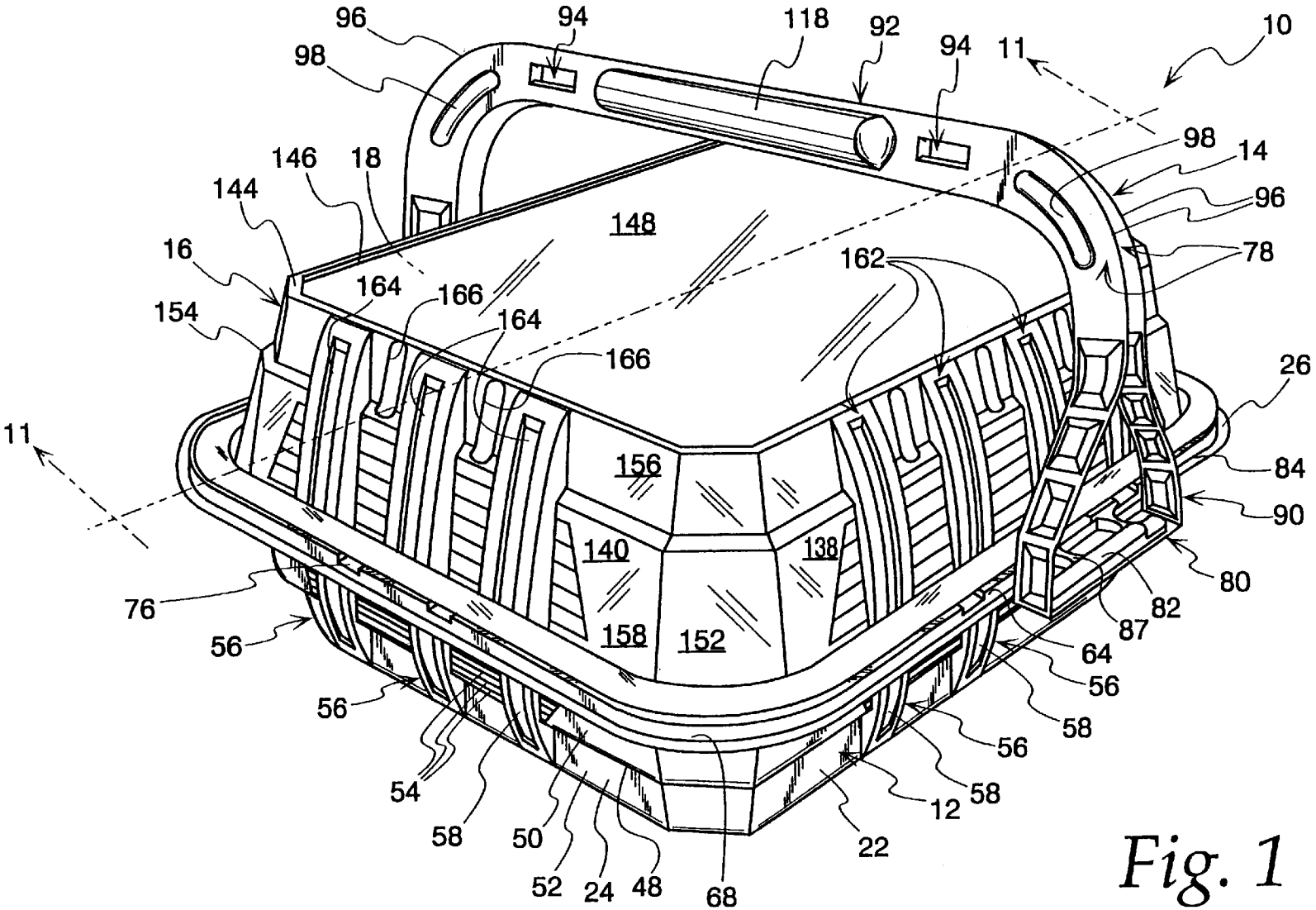
FIG. 1 is a perspective view of the container.

While the invention is susceptible to various modifications and alternative forms, a specific embodiment thereof has been shown by way of example in the drawings and will herein be described in detail. It should be understood, however, that it is not intended to limit the invention to the particular forms disclosed. Quite to the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
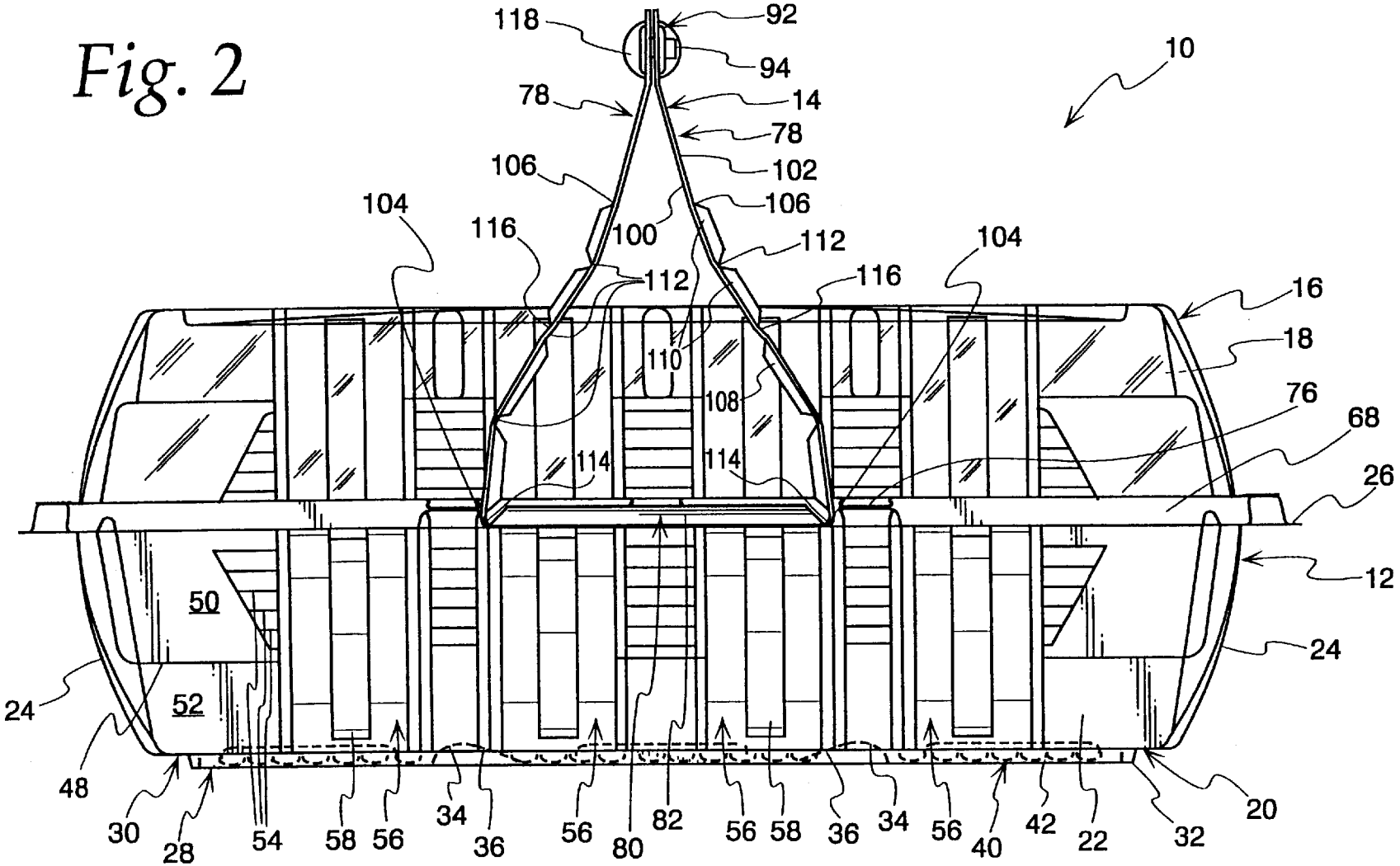
FIG. 2 is a side-elevational view of the container.

Referring now to FIGS. 1 and 2, a container 10 in accordance with the invention is shown. As illustrated, the container includes a base 12 having an integrally formed handle structure 14, and a vented cover 16 attached to the base with the base 12 and cover 16 defining a food storage chamber 18. The container 10 can have any desired shape, such as round, oval, square, etc., but is preferably rectangular.

With particular reference to FIGS. 3–6, the base 12 includes a bottom 20, two opposing side walls 22, two opposing end walls 24, and a rim 26 with integrally formed handle structure 14. The walls extend around the periphery of the base 12 defining a generally rectangular shape with the length of the longitudinal side walls being greater than the length of the end walls. The base 12 may be constituted of any kind of material suitable for food packaging systems such as oriented polystyrene (OPS), talc-filled polypropylene (TFPP), or polypropylene (PP).

The bottom 20 of the base 12 has a central receptacle portion 28 and a peripheral portion 30 that is formed along the periphery of the bottom 20 to surround the central receptacle portion 28. The peripheral portion 30 includes a channel 32 slightly recessed relative to the central receptacle portion 28 when viewed from inside the chamber 18.

In one embodiment, to help distribute the contents of the container 10 including the fluid by-product in a more optimum or expedient manner along the bottom 20 of the container 10, the central receptacle portion 28 is upwardly bowed. The convex surface as viewed from inside the chamber 18 of the central receptacle portion 28 directs fluid to flow away from the center and towards the side walls 22 and end walls 24.

Figure 4:
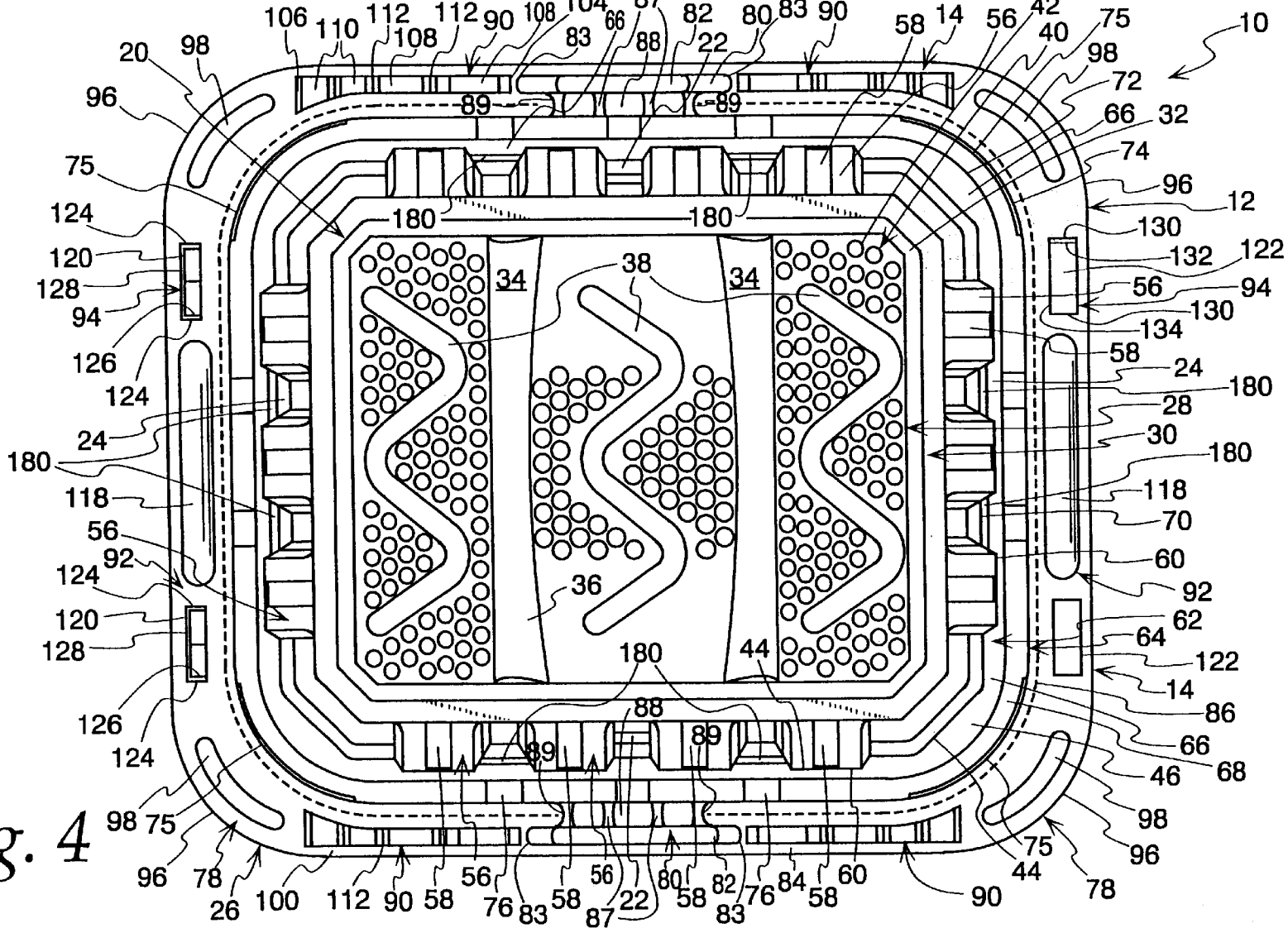
FIG. 4 is a top view of the base of the container.
Figure 5:
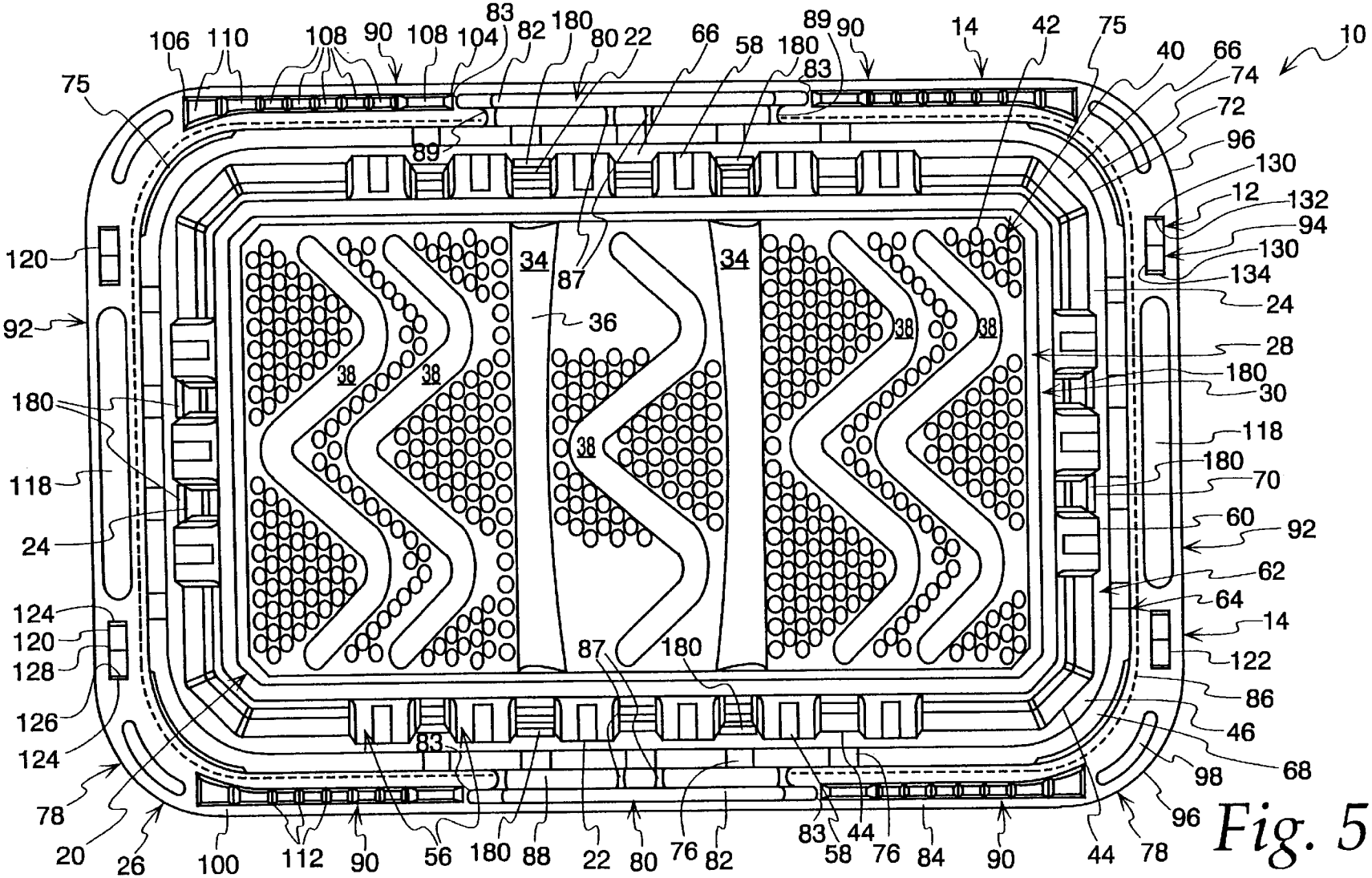
FIG. 5 is a top view of an alternative base of the container.

Focusing now on FIGS. 4 and 5, the central receptacle portion 28 can have a variety of surfaces. Preferably, the central receptacle portion 28 includes two substantially parallel handle recesses 34 for receiving portions of the handle structure 14 when folded over atop the cover 16 to facilitate stacking containers. The handle structure 14 of the base 12 will be discussed below. When viewed from inside the chamber 18, the recesses 34 form convex ribs having sloped inner surfaces 36.

In an alternative embodiment, the central receptacle portion 28 includes a plurality of ribs 38. For example, as shown in FIG. 5, five ribs 38 are formed in the central receptacle portion 28, each having a concavo-convex cross-section. One rib 38 is located between the recesses 34 and two are located on the outer side of each recess 34. As shown in FIG. 4, only one rib 38 is located on the outer side of each recess 34. The recesses 34 and the ribs 38 help raise the food from the bottom 20 and increase the stiffness of the base 12 enabling less material to be used in forming the base than would otherwise be the case.

Referring to FIGS. 4 and 5, the central receptacle portion 28 includes a plurality of closely-spaced integrally molded wells 40 intended for the collection of condensed moisture and juices emanating from the foods within the container 10. The wells 40 can be of any shape, such as any polyhedral, conical, cylindrical, parabolic, etc., but are preferably generally almost semi-spherical and sized small enough to take advantage of surface tension effects to contain fluid within the wells 40. The diameter of the semi-spherical wells 40 is approximately in the range of 1/32 to 1/4 inches.

When fluid by-product enters the wells 40, the open surface of the fluid within the wells 40 is under a state of surface tension which creates a tendency for portions of the surface to separate from each other especially at the boundaries due to the polarized dipoles of water molecules which determine their binding forces and water surface tension. Since the diameter of each dimple-like well 40 is small enough but not too small so as to prevent fluid from entering the wells 40, the surface of the fluid within the wells 40 shows surface tension properties similar to those of a stretched elastic film over the fluid. When the container 10 is then tilted, which frequently occurs while the container 10 is in transport, all or a portion of fluid collected in the central receptacle portion 28 does not spill out of the wells 40. Even when the base 12 is inverted, water does not leave the wells 40 unless vigorously shaken or blotted out.

When fluid migrates across the central receptacle portion 28, the fluid naturally accumulates inside the wells 40. Since the wells 40 are tightly arranged next to one another, stand substantially vertically with respect to the bottom 20 or central receptacle portion 28, any overflow from one well 40 is free to flow into adjacent wells 40. Thereby, the wells 40 help to prevent excess grease and moisture from contacting the food. Contact with the trapped fluid is also minimized as the food items are generally supported by well walls 42 in addition to the ribs 38 and recesses 34, thereby, preventing breading or the like from adhering to the bottom over time.

Trapping the condensate or other fluid in the wells 40 not only prevents the hot food item from contacting and reabsorbing the fluid, but also, advantageously maintains the food item in a warmed state. The warm water or condensate which is trapped in the wells 40 radiates its heat back into the food storage chamber 18 and potentially assists in keeping the hot food item warm. Likewise, when a container with food product is removed from the freezer, any frozen fluid in the wells can potentially assist in keeping the cold food item cool for a longer period of time.

Still referencing FIGS. 3–6, the four walls 22, 24 are integrally connected to the bottom 20 at the peripheral portion 30 and provide a curvilinear transition wall surface therebetween. The walls 22, 24 have an upper edge 44 and are interconnected at corners 46.

Each of the upwardly and outwardly extending walls 22, 24 has a step 48 dividing each wall into upper and lower portions 50, 52 with the upper portion 50 having a plurality of horizontal ribs 54. The upper and lower wall portions 50, 52 are spanned by a plurality of ribs 56 extending vertically from the bottom 20 of the container 10 to the upper edge 44 of the walls 22, 24. Each rib 56 includes a central vertical recess 58 when viewed from outside the chamber 18.

To aid the channeling of fluid condensate towards the bottom 20, each rib 56 is preferably outwardly bowed. The outwardly bowed ribs 56 project away from the upper and lower portions 50, 52 of the walls 22, 24 and define intermittent notches 60 in the upper edge 44 of the walls 22, 24. The number, size, and shape of the ribs 56 contained in each wall can vary without departing from the spirit of the invention.

As best seen in FIGS. 4 and 5, the rim 26 of the base 12 of the container 10 includes an inner flange 62, a horizontal middle planar flange 64, and a handle structure 14. The inner flange 62 projects laterally outwardly from the upper edge 44 of the walls 22, 24 and includes a shoulder 66 and an elongated rib 68. The shoulder 66 encompasses the walls 22, 24 and has an inner edge 70 defined by the upper edge 44 of the walls 22, 24. The width of the shoulder 66 varies along the walls 22, 24. For example, the width of the shoulder 66 is greater between ribs 56 and at the corners 46 between the walls 22, 24.

The elongated rib 68 of the inner flange 62 is continuously located along the rim 26 and encompasses the shoulder 66. The elongated rib 68 is integrally formed with the rim, projects upwardly from the rim 26, has an inner 72 and outer edge 74, and a substantially squared U-shaped cross-section. At the corners 46, the elongated rib 68 is curvilinear and of generally constant width and height and includes a finger dent 75 for providing finger access for removing the cover 16 from the base 12. Along the walls 22, 24, the elongated rib 68 is intermittently provided with venting notches 76 such that at each venting notch 76 the rib 68 is lower in height. The venting notches 76 can be of any shape. Generally, the venting notches 76 are rectangular and located on the elongated rib 68 between ribs 56 in the walls 22, 24 where the shoulder 66 of the inner flange 62 is greater in width. Such an arrangement helps to prevent fluid traveling along the ribs 56 from easily flowing out of the chamber 18 via the venting notches 76. The shoulder 66 and elongated rib 68 provide a resting ledge for holding the cover 16 and base 12 of the container 10 in a closed condition.

The horizontal middle planar flange 64 of the rim 26 is continuously located along the rim 26 and encompasses the inner flange 62. The width of the continuous middle planar flange 64 is generally constant along the rim 26 but may have any shape.

The handle structure 14 preferably includes a pair of handle segments 78 rotatably hinged to anchoring flanges 80. While one handle may be sufficient for a smaller container 10, a larger container 10 may include two or more handle segments 78 to stabilize the container 10 when carried. Also, the shape of the handle segments 78 may vary with the shape of the base 12. For a rectangular container 10, the handle segments 78 are generally substantially U-shaped. The handle segments 78 are disposed at opposite sides of the base 12 at substantially diametrically opposite points. For example, a pair of handle segments 78 may be disposed diagonally with respect to the base 12. Each anchoring flange 80 includes a reinforcing rib 82 extending upwardly from an upper surface 84 of the rim 26 and parallel to side walls 22. Each reinforcing rib 82 further includes a pair of curved rib ends 83.

The handle structure 14 is manufactured integrally with the base 12 of the container 10 and is a lateral extension from the middle planar flange 64. A score 86 may be made in the middle planar flange 64 such that the segments 78 may be freed from the base 12 of the container 10 but remain integrally connected to the anchoring flange 80. A portion 88 of material in the middle planar flange 64 is left unscored such that the anchoring flange 80 is not removable from the container 10. In one embodiment, the portion 88 of the middle planar flange 64 is bridged by a plurality of cross-ribs 87 as shown in FIGS. 4 and 5. The cross-rib 87 closest to each rib end 83 is positioned a distance away from the rib end 83 to form a substantially U-shaped recess 89. The score 86 extends into the U-shaped recess 89 to prevent the propagation of the score as a result of stress concentrations associated with repeated rotation of the handle segments 78.

By "score," it is understood to mean a partial depth cut in the material or equally a cut completely through the material. If the material is completely cut, then the handles 78 are free to be flexed. If the score line 86 is not completely cut through the container material, a user may grasp a handle segment 78 and break or cut the remaining material so as to free the handle. Also, partial scoring along the lateral length of the handles can form breakaway interferences such that some material of the container remains intact. Then, a user need only break the relatively small amount of remaining material constituting the breakaway interferences to free the handles 78. When the handle segments 78 are separated from the base 12, they are free to rotate about the anchoring flange 80 in upward and downward swinging movements. While in their normal free positions they lie slightly above or approximately level with the rim 26 of the base 12, or depend slightly therebelow.

Each substantially U-shaped handle 78 includes a pair of hinged portions 90, a manually graspable central portion 92, and preferably a locking structure 94. Each hinged portion 90 of the handle 78 is integrally interconnected with the graspable central portion 92 at a corner flange 96. To increase handle stiffness, a small corner rib 98 is provided in the corner flange 96. The hinged portions 90 of each handle are substantially parallel and adjacent to the side walls 22 when formed and disposed at opposite sides of the base 12 at substantially diametrically opposite points. The length and design of the hinged portion can vary with the size of the container 10. For example, a container 10 with a base length of approximately 8.0 inches, as measured between end walls 24, has a hinged portion 90 of approximately 1.3 inches long;

whereas, a container with a base length of approximately 12.0 inches, as measured between end walls 24, has a hinged portion 90 of approximately 3.6 inches long. While each hinged portion 90 is identical and like numerals are used to designate like parts, it should be understood that the configuration of each hinged portion 90 may vary.

Each hinged portion 90 includes an upper surface 100, a lower surface 102, a first end 104, a second end 106, at least one upwardly extending rib segment 108, at least one downwardly extending rib segment 110, and at least one integral hinge 112. Generally, the integral hinges 112 are formed by molding portions of material with a thickness that permits bending of such material portions with ease and without breaking. Preferably, when formed, the upwardly extending rib segments 108 are located proximate the first end 104 and the downwardly extending rib segments 110 are located proximate the second end 106 of the hinged portion 90. Consecutive upwardly extending rib segments 108 are interconnected at integral hinges 112 formed by integrally molded notches 114 in the upper surface 100, and consecutive downwardly extending rib segments 110 are interconnected at integral hinges 112 formed by integrally molded notches 114 in the lower surface 102 of the hinged portion 90. Also, a notch 114 is located at the junction of the first end 104 of the hinged portion and the anchoring flange 80. Notches 114 and integral hinges 112 may be of any shape but are preferably V-shaped. A transition hinge 116 is located between consecutive upwardly and downwardly extending rib segments 108, 110. Each hinge 112 forms definite bending points for the hinged portion 90 of the handle structure 14 so that when the handle segments 78 are upturned, as shown in FIG. 2, the hinged portion 90 assists in distributing stress and obtaining proper balance of the container 10.

Figure 3:
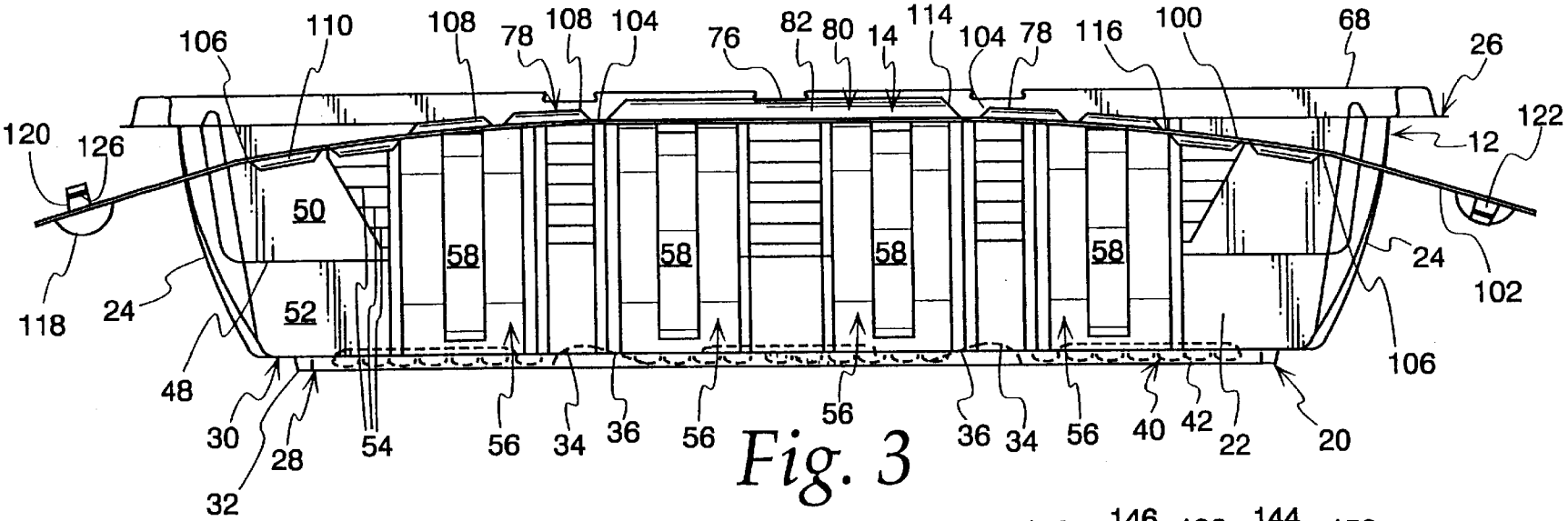
FIG. 3 is a side-elevational view of a base of the container.

In addition to the integral hinges 112, the number, size, and length of the rib segments 108, 110 help define the articulation of the hinged portion 90. With particular reference to FIGS. 3 and 4, in one embodiment for a container approximately 8.0 inches in length, there are two upwardly extending ribs 108 proximate to the first end 104 and two downwardly extending ribs 110 proximate the second end 106. The rib segment closest to the first end 104 is approximately ⅜ inch in length and is longer than the other rib segments 108, 110 in the hinged portion 90. The other upwardly extending rib segment is approximately ¼ inch in length and, in one embodiment, slightly shallower than the innermost rib segment. The two downwardly extending rib segments 110 are also approximately ¼ inch in length. The number, shape, size, and orientation of the rib segments can vary without departing from the spirit and scope of the invention. Generally, the larger the container 10 the more rib segments are included throughout the hinged portion 90.

Figure 6:
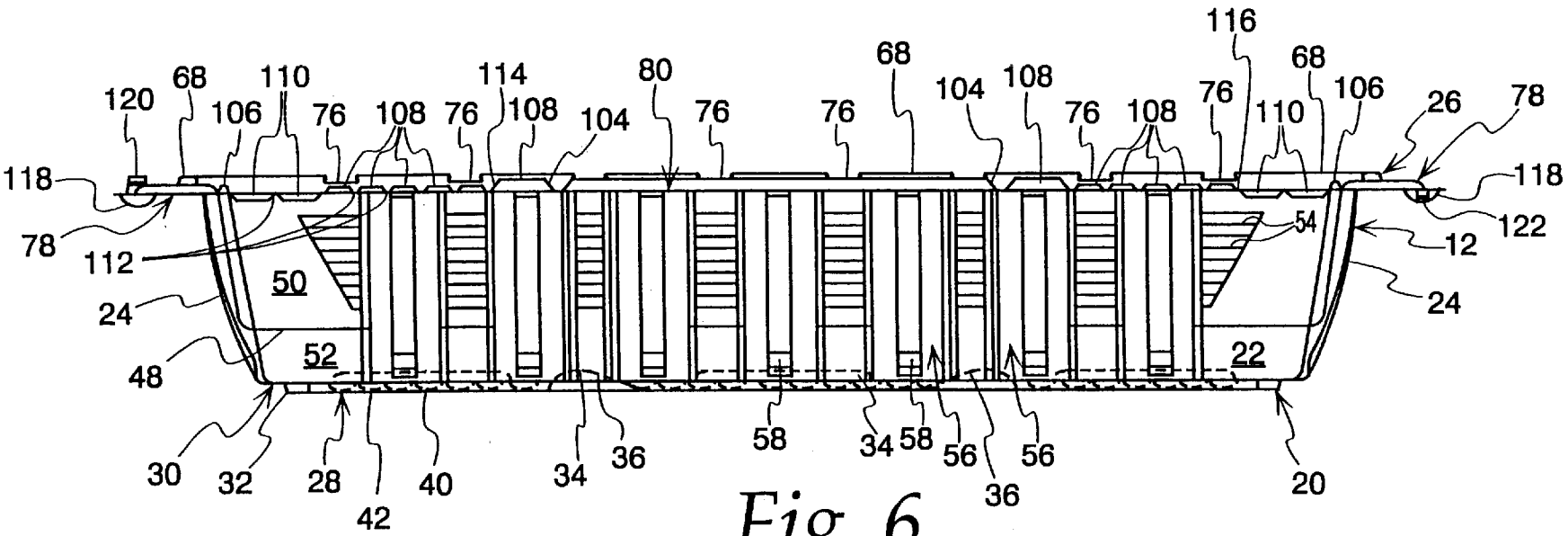
FIG. 6 is a side-elevational view of the alternative base of the container.

With particular reference now to FIGS. 5 and 6, in an alternative embodiment for a 12.0 inch container having a hinged portion length of approximately 3.63 inches, there are six upwardly extending rib segments 108 and two downwardly extending rib segments 110 positioned in a fashion similar to that described above for a container 10 approximately 8.0 inches in length. The rib segment closest to the first end 104 is approximately ½ inch in length and is longer and deeper than the other ribs 108, 110 in the hinged portion 90. The five upwardly extending rib segments, other than the innermost rib segment, are approximately 7/32 inch in length and slightly shallower than the innermost rib segment. The two downwardly extending rib segments 110 are approximately ⅜ inch in length and approximately the same depth as the five upwardly extending rib segments 108.

Generally, in one embodiment, the hinged portion 90 includes at least one inner rib segment located proximate to the first end 104, at least one outer rib segment located near the second end, and at least one middle rib segment located therebetween. The inner rib segments are generally deeper than the shallower middle and outer rib segments. Also, the inner rib segment is longer than the outer rib segment which is longer than the middle rib segment. As with the smaller container, the number, shape, size, and orientation of the rib segments can vary without departing from the spirit and scope of the invention.

The unique combination of integral hinges 112, number, size, orientation, and length of the rib segments 108, 110 aids in properly balancing the container 10 when lifted by the handle segments 78. The resulting increased flexibility of the hinged portions 90 helps to maintain the container level when in transport and, thereby, prevent spillage. Furthermore, the hinged handle structure 14 permits easy upward or downward articulation of the handle segments 78.

The graspable central portions 92 are substantially parallel to the end walls 24 and are adjacent thereto when formed. Each graspable central portion 92 is preferable provided with an integrally formed elongated bead 118 having a concavo-convex cross-section. This cross section increases the stiffness of the handles and also provides for a more substantial feel when grasped. When the handle segments 78 are in an upturned position, the graspable central portions 92 are disposed side-by-side to constitute a double handle and the beads 118 come together to form a substantially cylindrically-shaped graspable portion 92 having the look and feel of unitary handle. The beads 118 together may form a graspable portion 92 having any shape including rectangular and ergonomic.

The locking structure 94 enables the upturned handle segments 78 to be latched together. The preferred locking structure 94 is shown in U.S. Pat. No. 5,046,659 issued to Warburton on Sep. 10, 1991 and is incorporated herein by reference in its entirety. The locking structure 94 includes a pair of substantially rectangular male ribs 120 extending from one of the handle segments 78 and a pair of substantially rectangular depending female recesses 122 formed in the other handle segment 78 positioned and dimensioned to receive the cooperating male ribs 120. The opposite ends 124 of each male rib have an outwardly extending shoulder structure 126 with sides 128 of the male rib 120 being substantially straight. Each female recess 122 includes opposite ends 130 having an inwardly extending shoulder structure 132 adapted to mate with the outwardly extending shoulder structure 126 of the male rib 120. The sides 134 of the female recess 122 are substantially straight. When the male rib 120 is pressed into the female recess 122, the ends of the male rib 120 and female recess 122 will deflect with respect to each other so that the shoulder structure 126 on the male rib 120 will snap into position beneath the shoulder structure 132 in the female recess 122 and interlock therewith to latch the handle segments 78 together. A variety of other locking structures of various shapes are equally possible such as any interference-fit engagement having, for example, a round or any polygonal shape.

The ribs 120 and recesses 122 of the locking structure 94 can be located anywhere in the handle segments 78 such as in each of the corner flanges 96 but are preferably provided along the central portion 92 on opposite sides of the bead 118 between the bead 118 and corner flange 96. Alternatively, one female recess 122 and one male rib 120 can be located on one of the handle segments 78 with a cooperating male rib 120 and cooperating female recess 122 opposingly located on the other handle segment 78. Any combination, number, or arrangement of male ribs 120 and female recesses 122 are possible without departing from the spirit and scope of the invention.

Figure 7:
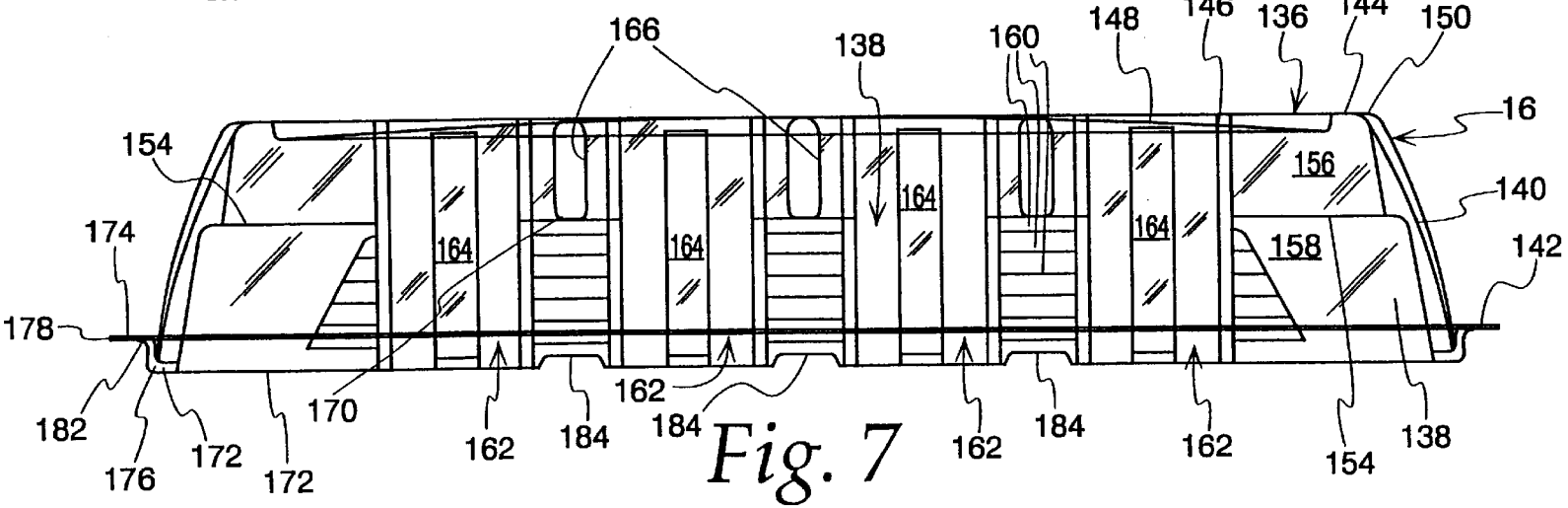
FIG. 7 is a side-elevational view of a cover of the container.
Figure 8:
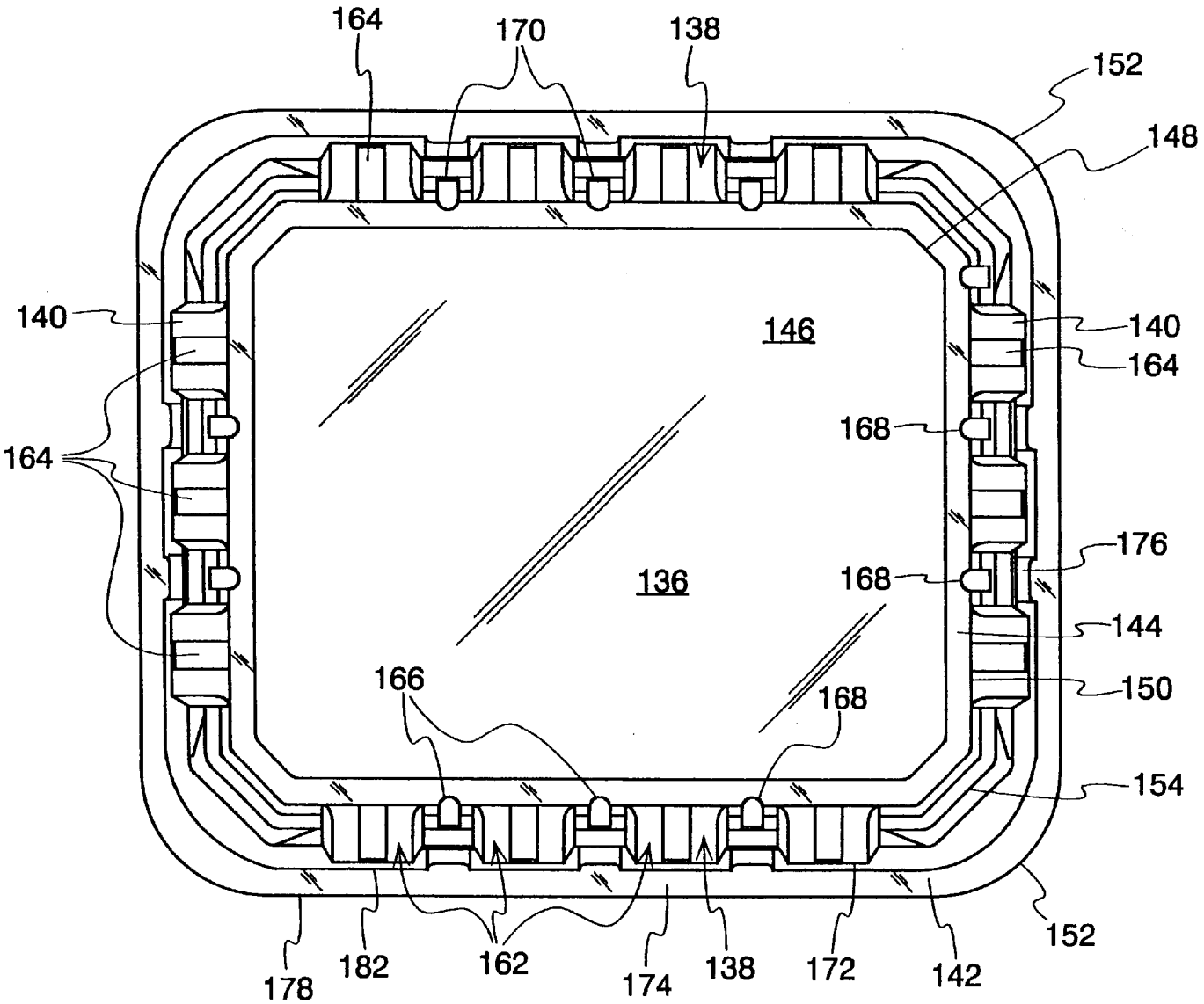
FIG. 8 is a top view of the cover of the container.
Figure 9:
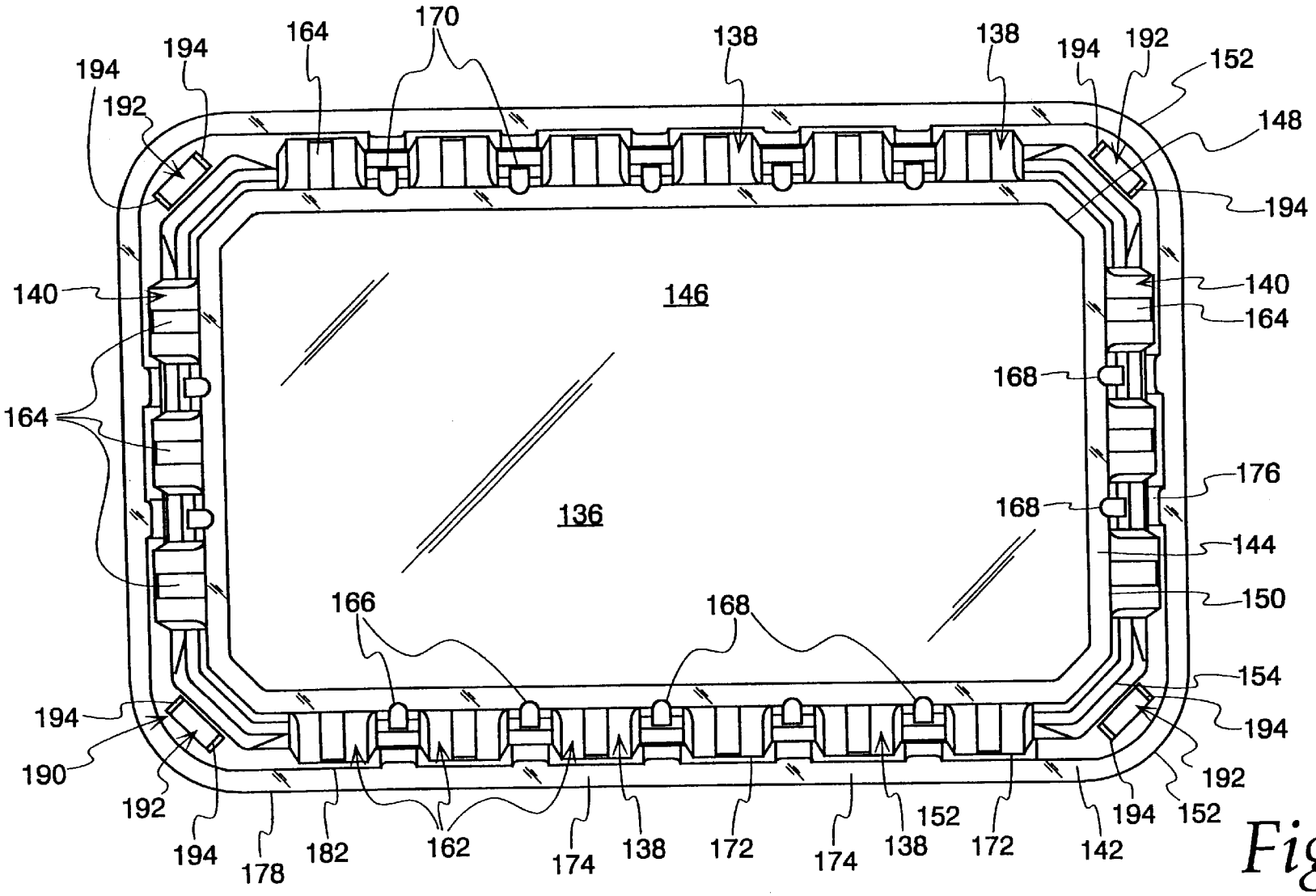
FIG. 9 is a top view of an alternative cover of the container.

Referring now to FIGS. 7–9, the cover 16 of the container 10 has a top 136, two side walls 138, two end walls 140, and a rim 142. The side walls 138 and end walls 140 extend around the periphery of the top 136 defining a shape corresponding to the base 12. The cover 16 has a generally rectangular shape with the length of the opposing longitudinal side walls 138 being greater than the length of the opposing end walls 140. The cover 16 of the container is preferably made from any clear moldable plastic material such as oriented polystyrene (OPS), talc-filled polypropylene (TFPP), or polypropylene (PP), or polyvinyl chloride (PVC), and may be provided with an anti-fog surfactant.

The top 136 of the cover 16 has a raised peripheral portion 144 encompassing a recessed central portion 146 having an outwardly bowed dome 148. As viewed from inside the chamber 18, the concavity of the dome 148 permits any moisture condensed on the dome 148 to travel towards the walls 138, 140 rather than falling directly onto the food product. The walls 138, 140 are integrally connected to the top 136 at an upper edge 150 and provide a smooth curvilinear transition between the raised peripheral portion 144 and the walls 138, 140. The walls 138, 140 are interconnected at corners 152.

Each of the downwardly extending and outwardly sloped walls 138, 140 has a step 154 dividing each wall into upper 156 and lower 158 portions with the lower portion 158 having a plurality of horizontal ribs 160. The upper and lower wall portions 156, 158 are spanned by a plurality of ribs 162 extending vertically from the rim 142 to the upper edge 150 at the top 136 of the walls 138, 140. Generally, each rib 162 includes a central vertical recess 164 when viewed from outside the chamber 18 and is outwardly bowed to aid in the channeling of fluid condensate towards the bottom 20 of the container 10. The outwardly bowed ribs 162 project away from the upper and lower portions 156, 158 of the walls 138, 140. The number, size, and shape of the ribs 162 contained in each wall 138, 140 can vary without departing from the spirit of the invention.

To provide ventilation between the food storage chamber 18 and the outside of the container 10, the upper wall portion 156 includes a plurality of elongated fluted openings 166. The openings 166 are generally located between ribs 162 and have an arcuate upper end 168 at the upper edge 150 of the walls 138, 140 and a lower end 170 at the step 154.

The size and number of openings 166 provided in the cover 16 can vary with the size of the container 10 or with the optimum ventilation requirements of anticipated food product carried within the container. For example, each opening 166 is approximately 0.25 in.$^2$ Generally, each side wall 138 of the 8 inch container 10 includes three openings 166 and each end wall includes two openings 166. Generally for the 12 inch container 10, each side wall 138 includes five openings 166 and each end wall includes two openings 166.

As best seen in FIGS. 7–9, the four cover walls 138, 140 are interconnected with the peripheral rim 142 at a lower edge 172. The rim 142 includes a substantially horizontal outer flange 174, and a depending scalloped rib 176. While the outer flange 174 is shown to have a substantially straight outer edge 178 at the walls 138, 140 and a smooth curvilinear transition at the corners 152, the outer flange 174 may have any shape. The outer flange 174 encompasses the depending scalloped rib 176 and is interconnected therewith at an inner edge 182 of the outer flange 174.

The depending scalloped rib 176 encompasses all four walls 138, 140 and is located between the inner edge 182 of the outer flange 174 and the lower edge 172 of the walls 138, 140. The cross-section of the scalloped rib 176 is substantially U-shaped with a plurality of elongated beveled vent openings 184 intermittently provided in the rib 176 along the length of the side walls 138 and end walls 140 positioned to align with venting notches 76 of the base rim 26. The beveled vent openings 184 can be of any shape and size to serve different venting or locking purposes. As a result of the beveled vent openings 184, the depth of the rib 176 varies. The scalloped rib 176 is deeper at locations adjacent to the ribs 162 than in areas between ribs where the beveled vent openings 184 are provided. Also, the width of the scalloped rib 176 varies. The scalloped rib 176 is wider between ribs 162 than in areas adjacent to the outwardly extending ribs 162. The scalloped rib 176 not only serves important venting functions but also together with the outer flange 174 of the cover rim 142 provide features for securing the cover 16 to the base 12 of the container 10.

The cover 16 is adapted for placement over the base 12 to define the food storage chamber 18 in which the food product is housed during storage and transport. The peripheral configuration of the cover 16 is adapted for complementary press-fittable engagement with the rim 26 of the base 12 such that the scalloped rib 176 of the cover 16 is positioned slightly interior to the elongated rib 68 of the base 12. When the cover 16 is pressed onto the base 12, the cover 16 and base 12 will flex slightly and the scalloped rib 176 of the cover 16 will snap into position interior to the elongated rib 68 of the base 12 to latch the cover 16 to the base 12. The cover 16 is held in position against the elongated rib 68 in a friction or interference-fit engagement. When the cover 16 is placed on the base 12 and the container 10 is in a closed position, the outer flange 174 of the cover 16 rests on portions of the elongated rib 68 of the base 12 and the scalloped rib 176 of the cover 16 rests atop the shoulder 66 of the base 12. The shoulder 66 of the base 12 may further be provided with at least one cover anti-deflection protrusion 180 in order to help secure the cover and prevent buckling. The cover 16 may be preferably completely detachable from the base 12 or, alternatively, may be hingely coupled thereto to close or open the food storage chamber 18 as access is needed.

In another embodiment as shown in FIG. 9, to secure the cover 16 to the base 12, the container 10 is provided with a latching structure 190. The preferred latching structure 190 is shown in U.S. Pat. No. 5,046,659 issued to Warburton on Sep. 10, 1991 and in U.S. patent application Ser. No. 09/113,645 filed on Jul. 10, 1998; both are incorporated herein by reference in their entirety. The latching structure 190 is similar to the locking structure 94 described above for locking handle segments 78 together. The latching structure 190 includes four substantially rectangular male ribs 192 formed in the scalloped rib 176 at the corners 152 of the cover 16 as shown in FIG. 9. Substantially rectangular female recesses (not shown) are formed in the base 12 and are positioned and dimensioned to receive the male ribs 192. Each male rib 192 includes a shoulder structure 194 that interlocks with the female recess to latch the cover 16 and base 12 together. A variety of other latching or positioning structures of various shapes are equally possible such as any interference-fit engagement having, for example, a round or polygonal shape. For example, in one embodiment, complementary male and female cone-shaped protrusions (not shown) are formed in the scalloped rib 176 and base 12 to position the cover 16 atop the base 12.

The ribs 192 and recesses of the latching structure 190 can be located anywhere in the base 12 and cover 16. Alternatively, female recesses can be formed in the cover 16 and cooperating male ribs can be opposingly located in the base 12. Any combination, number, or arrangement of male ribs 192 and female recesses as well as locking features are possible without departing from the spirit and scope of the invention.

With the cover 16 and base 12 engaged, the ribs 56 in the cover 16 are substantially vertically aligned with ribs 162 in the base 12. The ribs 56, 162 can also provide interlocking camming surfaces for stacking multiple containers as shown, for example, in U.S. patent application Ser. No. 08/037,353 filed on Mar. 26, 1993 by Jay M. Wiley which is incorporated herein by reference in its entirety.

Figure 10:
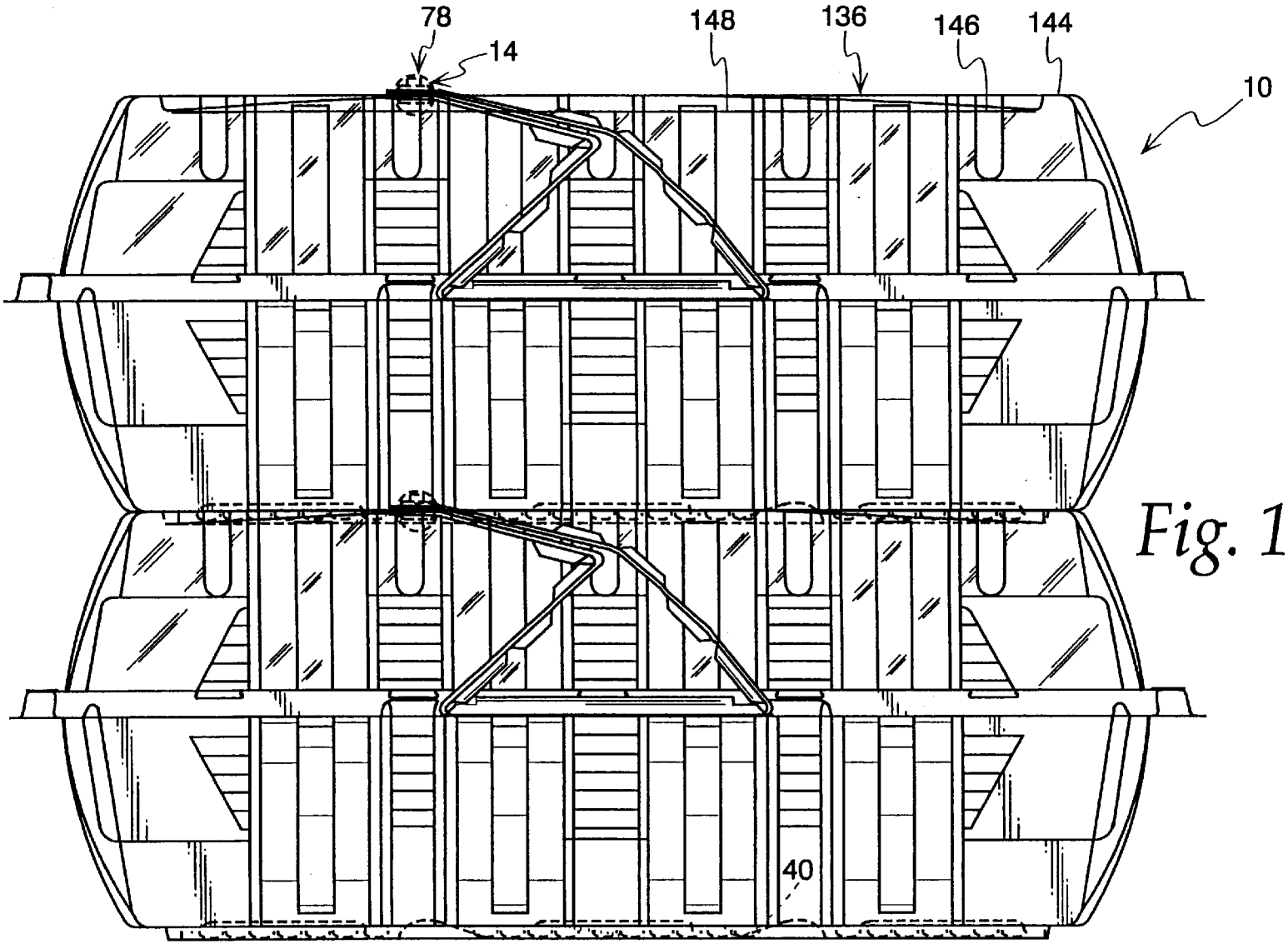
FIG. 10 is a side-elevational view of one container stacked atop another container.

As shown in FIG. 10, a series of covered containers may be vertically stacked on top of one another in a secure arrangement by inserting the depending channel 32 of the base 12 into the complementary recessed central portion 146 of the top 136. The raised peripheral portion 144 of the top 136 provides camming surfaces for the channel 32 of the bottom 20 and vice versa. A container 10 is easily stacked atop another even with the locked handle segments 78 resting on top of the cover 16 as portions of the handle structure 14 of a lower container 10 are received within the recesses 34 of an upper container 10.

Figure 11:
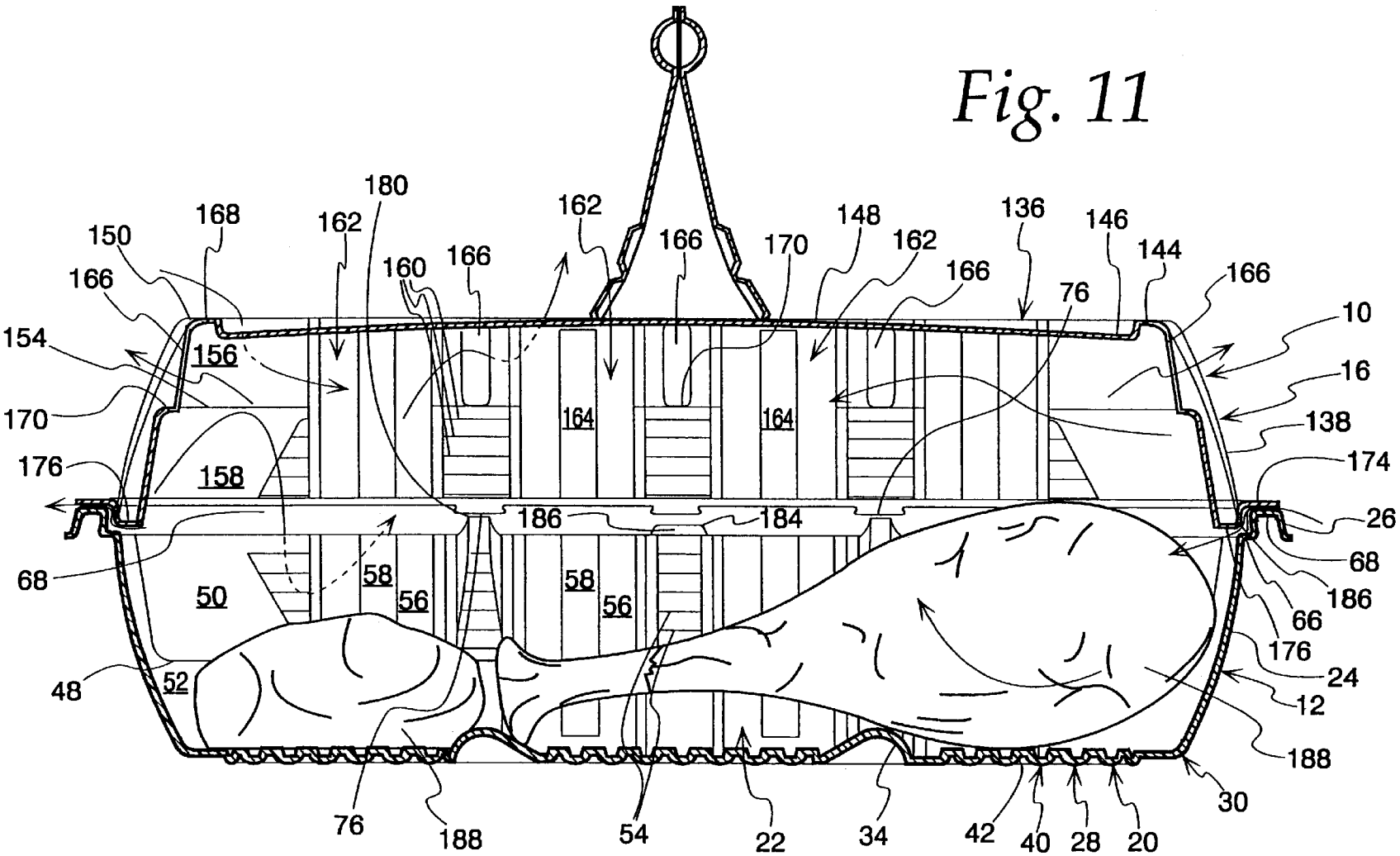
FIG. 11 is a cross-sectional view taken generally along line 11—11 in FIG. 1.

As best seen in FIG. 11, when the cover 16 is in position atop the base 12 of the container 10 a plurality of venting apertures 186 is formed along the interface of the base 12 with the cover 16 where the cover 16 is spaced from the base 12 of the container 10 to form venting apertures 186 that allow for the venting of steam which may emanate from hot foods within the container 10. The venting apertures 186 are generally located between ribs 56, 162 of the cover 16 and the base 12 and are defined by the conjunction of the beveled vent openings 184 of the cover 16 with the venting notches 76 in the base 12. Hence, the multiplicity of intermittent elongated venting apertures 186 extends along the interface of the cover 16 and the base 12.

During normal operation, presence of hot food product 188 in the chamber 18 and possible heating thereof by heat lamps raise the temperature of the air within the chamber 18 and create natural convection air currents therein indicated by arrows shown in FIG. 11. The hot air inside the chamber 18 flows upwardly and out through the fluted openings 166. This air flow through the chamber 18 and out the fluted openings 166 draws cool air into the chamber 18 from the exterior of the container 10 through the venting apertures 186, thereby removing moisture and keeping the air temperature within the chamber 18 below the maximum critical moisture and temperature of the food product.

The design and number of vents 166, 186 can be altered depending on the desired consistency of the food product placed within the chamber 18. If the vents 166, 186 are larger or more numerous, then more moisture will readily escape from the chamber 18. The result of having an ideal number of openings is a food product that is warm enough to eat without having a compromised texture. Greater ventilation will allow the food product such as fried chicken to remain crispier. Less ventilation as a result of closed or fewer vents, reduces the possible escape of vapors creating a condition of maximum heat retention. As a result, moisture emanating from the food product in the form of steam surrounds the food product and may render the food product too soggy. The number of fluted openings 166 can be customized according to the food carried by the container 10. Adequate venting is provided when the containers 10 are stacked one on top of another without the upper container blocking the vent openings of the one below.

Each of these embodiments and obvious variations thereof is contemplated as falling within the spirit and scope of the claimed invention, which is set forth in the following claims.

What is claimed is:

1. A thermoplastic container, comprising:

a bottom;

a pair of opposing side walls and a pair of opposing end walls, said side walls and said end walls extending upward from said bottom, said end walls extending between said side walls; and a base rim encompassing an upper edge of said side walls and said end walls and extending laterally outwardly therefrom, said rim having an integrally formed outer flange with a pair of opposing anchoring portions, said outer flange forming at least one handle segment, each of said handle segments having a pair of generally parallel hinged portions and a graspable portion extending between said hinged portions, said hinged portions being rotatably connected to said respective anchoring portions for upward and downward swinging movements, said handle segments having means for releasably engaging said handle segments to each other, each of said hinged portions having at least one rib segment extending from a surface of the associated hinged portion, and at least one integral hinge forming a definite bending point.

2. The container of claim 1, wherein consecutive ones of said rib segments are interconnected at integral hinges.

3. The container of claim 2, wherein said integral hinges between said consecutive rib segments are formed by substantially V-shaped integrally molded notches.

4. The container of claim 1, wherein at least one of said rib segments is adjoined and rotatably hinged to said anchoring portion.

5. A thermoplastic container, comprising:

a bottom;

a continuous wall extending upward from and encompassing the bottom; and a rim extending laterally from an upper portion of the continuous wall and including an outer flange, the outer flange having anchoring portions and a pair of hinged handles, the handles being hingedly connected to the anchoring portions for upward and downward swinging movement, each of the handles having at least one rib segment extending from a surface of the associated handle and at least one integral hinge forming a definite bending point, and means for releasably engaging the handles to each other above a remainder of the container.

6. A thermoplastic container, comprising:

a bottom;

a continuous wall extending upward from and encompassing the bottom; and a rim extending laterally from an upper portion of the continuous wall and including an outer flange, the outer flange having anchoring portions and a pair of hinged handles, the handles being hingedly connected to the anchoring portions for upward and downward swinging movement, each of the handles having a plurality of rib segments extending upwardly from an upper surface of the associated handle and a plurality of rib segments extending downwardly from a lower surface of the associated handle, and means for releasably engaging the handles to each other above a remainder of the container.

7. The container of claim 6, wherein consecutive ones of said rib segments are interconnected at integral hinges.

8. The container of claim 7, wherein said integral hinges between said consecutive rib segments are formed by substantially V-shaped integrally molded notches.

9. The container of claim 6, wherein at least one of said rib segments is adjoined and rotatably hinged to said anchoring portion.

10. The container of claim 5, wherein the anchoring portions are disposed on opposite sides of the rim, each of the anchoring portions including a first end and a second end, one of the handles being hingedly connected to the first end of each of the anchoring portions, the other of the handles being hingedly connected to the second end of each of the anchoring portions.

11. The container of claim 5, wherein the engaging means is formed by a button on one of the handles and a recess on the other of the handles, the button being adapted to releasably engage within the recess.

12. A thermoplastic container, comprising:

a bottom;

a continuous wall extending upward from and encompassing the bottom;

a rim extending laterally from an upper portion of the continuous wall and including an outer flange, the outer flange having anchoring portions and a pair of hinged handles, the handles being hingedly connected to the anchoring portions for upward and downward swinging movement, each of the handles having at least one rib segment extending from a surface of the associated handle and at least one integral hinge forming a definite bending point, the handles forming a button latch for releasably engaging the handles to each other above a remainder of the container.

13. The container of claim 12, wherein the button latch is formed by a button on one of the handles and a recess on the other of the handles, the button being adapted to releasably engage within the recess.

14. The container of claim 12, wherein each of the handles includes a plurality of stiffening ribs.

15. The container of claim 12, wherein the anchoring portions are disposed on opposite sides of the rim, each of the anchoring portions including a first end and a second end, one of the handles being hingedly connected to the first end of each of the anchoring portions, the other of the handles being hingedly connected to the second end of each of the anchoring portions.

* * * * *

UNITED STATES PATENT AND TRADEMARK OFFICE

CERTIFICATE OF CORRECTION

PATENT NO. : 6,349,847 B1
DATED : February 26, 2002
INVENTOR(S) : Mangla et al.

It is certified that error appears in the above-identified patent and that said Letters Patent is hereby corrected as shown below:

Column 14,
Line 11, delete "said" and insert -- the --

Signed and Sealed this

Sixteenth Day of July, 2002

*Attest:*

*Attesting Officer*

JAMES E. ROGAN
*Director of the United States Patent and Trademark Office*